US010322303B2

(12) United States Patent
Qian et al.

(10) Patent No.: US 10,322,303 B2
(45) Date of Patent: Jun. 18, 2019

(54) PM 2.5 MASK

(71) Applicant: Beijing FUNATE Innovation Technology Co., LTD., Beijing (CN)

(72) Inventors: Li Qian, Beijing (CN); Yu-Quan Wang, Beijing (CN)

(73) Assignee: Beijing FUNATE Innovation Technology Co., LTD., Beijing (CN)

( * ) Notice: Subject to any disclaimer, the term of this patent is extended or adjusted under 35 U.S.C. 154(b) by 964 days.

(21) Appl. No.: 14/751,161

(22) Filed: Jun. 26, 2015

(65) Prior Publication Data

US 2016/0016022 A1 Jan. 21, 2016

(30) Foreign Application Priority Data

Jul. 16, 2014 (CN) ..... 2014 2 0392742 U

(51) Int. Cl.
*A62B 23/02* (2006.01)
*A41D 13/11* (2006.01)

(52) U.S. Cl.
CPC ..... *A62B 23/025* (2013.01); *A41D 13/1192* (2013.01)

(58) Field of Classification Search
CPC ... A62B 23/025; A41D 13/11; A41D 11/1192; A41D 31/0083; B01D 2239/025; B01D 2239/065; B01D 39/2041; B01D 39/2055; B01D 39/2065; B01D 46/546; B32B 5/26; B32B 29/002; C01B 2202/06; C01B 2202/08; C01B 2202/02
USPC ..... 128/205.29, 206.12
See application file for complete search history.

(56) References Cited

U.S. PATENT DOCUMENTS 5,628,308 A * 5/1997 Harges, Jr. ..... A41D 13/1153 128/201.25
2006/0150980 A1* 7/2006 Kim ..... A62B 23/06 128/206.18
2009/0110897 A1* 4/2009 Humfeld ..... B32B 7/14 428/221
2009/0211581 A1* 8/2009 Bansal ..... B32B 5/18 128/206.19
2010/0272950 A1* 10/2010 Chen ..... B32B 5/26 428/113
2012/0135234 A1* 5/2012 Netravali ..... B01D 39/1615 428/401
2012/0234694 A1* 9/2012 Vecitis ..... B01D 39/2055 205/747
2013/0295320 A1* 11/2013 Liu ..... B32B 5/12 428/113
2016/0015098 A1* 1/2016 Conlon ..... A62B 23/025 128/863

* cited by examiner

*Primary Examiner* — Gregory A Anderson
*Assistant Examiner* — Margaret M Luarca
(74) *Attorney, Agent, or Firm* — ScienBiziP, P.C.

(57) ABSTRACT

A mask against atmospheric PM 2.5 includes a mask body and a filter layer located in the mask body. The filter layer includes a carbon nanotube structure. The carbon nanotube structure includes a plurality of carbon nanotube films stacked and crossed with each other. The carbon nanotube structure includes a plurality of micropores. A diameter of the micropores ranges from about 1 micrometer to about 2.5 micrometers.

12 Claims, 8 Drawing Sheets

PM 2.5 MASK

CROSS-REFERENCE TO RELATED APPLICATIONS

This application claims all benefits accruing under 35 U.S.C. § 119 from China Patent Application No. 201420392742.9, filed on Jul. 16, 2014, in the China Intellectual Property Office, the contents of which are hereby incorporated by reference.

BACKGROUND

1. Technical Field

The disclosure generally relates to protective masks.

2. Description of Related Art

PM 2.5 refers to particles with notional diameter of less than 2.5 μm. Compared with large diameter particles, PM 2.5 has small particle size, large surface area, and high activity. PM 2.5 easily adsorbs toxic substances, such as heavy metals and microorganisms. Additionally, PM 2.5 can stay a long time in the air. Thus the air pollution is more serious with an increasing concentration of PM 2.5 in the air. Breathing PM 2.5 is very unhealthy.

PM 2.5 masks can be used to protect people from PM 2.5. Conventional PM 2.5 masks are mostly made of multilayer non-woven fabric, which has many defects, such as large thickness, large mass, and poor filtration.

BRIEF DESCRIPTION OF THE DRAWINGS

Implementations of the present technology will now be described, by way of example only, with reference to the attached figures.

DETAILED DESCRIPTION

Figure 1:
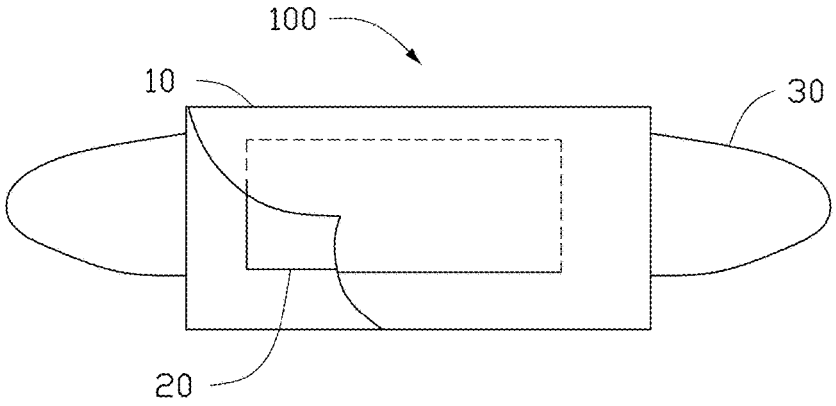
FIG. 1 is a sectional schematic view of one embodiment of a PM 2.5 mask.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape or other feayure that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like. The expression "PM 2.5" can refer to particles of solid matter with a notional diameter of less than 2.5 μm or to a device to function against particles of such size.

FIG. 1 illustrates one embodiment of a PM 2.5 mask 100, which includes a mask body 10, a filter layer 20, and two ties 30. The mask body 10 includes an inner layer and an outer layer, a gap is formed between the inner layer and the outer layer. In another embodiment, the mask body 10 is a multilayered structure. The filter layer 20 is located in the gap, and can filter out PM 2.5. Each tie 30 is located on opposite sides of the mask body 10. The two ties 30 are used to fix the PM 2.5 mask 100 on the ears of a wearer. An opening (not shown) is located on one side of the mask body 10, and is used to replace the filter layer 20. Two ends of the opening are connected via a connector.

A material of the mask body 10 can be a thin and gas-permeable material. The material can be cotton, silk, gauze, non-woven fabric, hemp, fiber, nylon, spandex, polyester, polyacrylonitrile, or the like. In one embodiment, the material of the mask body 10 is a material modified with air anions. Air anions of the material modified with air anions can reduce an activity of microorganisms and bacteria in the air, thereby inhibiting survival of the microorganisms and bacteria. The air anions of the material modified with air anions can also neutralize polluted micro-particles with positive ions in the air, to purify the air.

In one embodiment, the mask body 10 is a one-piece structure. In another embodiment, the mask body 10 includes at least two layers sewn or bonded together. The mask body 10 can be circular-arc, semi-spherical, proculiform, rectangular, or other shape. In one embodiment, the mask body 10 is rectangular, and the material of the mask body 10 is non-woven fabric.

The connector allows the opening to be opened or closed repeatedly. The connector can be velcro, zipper, button, snap, pin, or the like. In one embodiment, the PM 2.5 mask 100 does not include an opening and a connector.

In one embodiment, the two ties 30 are flexible. In one embodiment, the PM 2.5 mask 100 includes only one tie 30, the two ends of the tie 30 being located on opposite sides of the mask body 10. In another embodiment, the PM 2.5 mask 100 does not include a tie 30, the PM 2.5 mask 100 is pasted or otherwise adhered on the wearer's skin.

Figure 2:
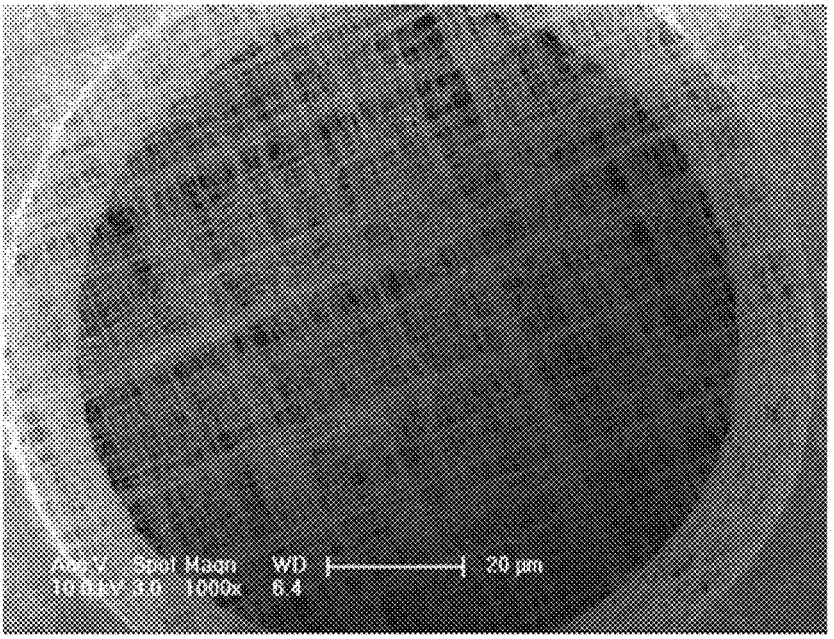
FIG. 2 is a scanning electron microscope (SEM) image of a carbon nanotube structure.
Figure 3:
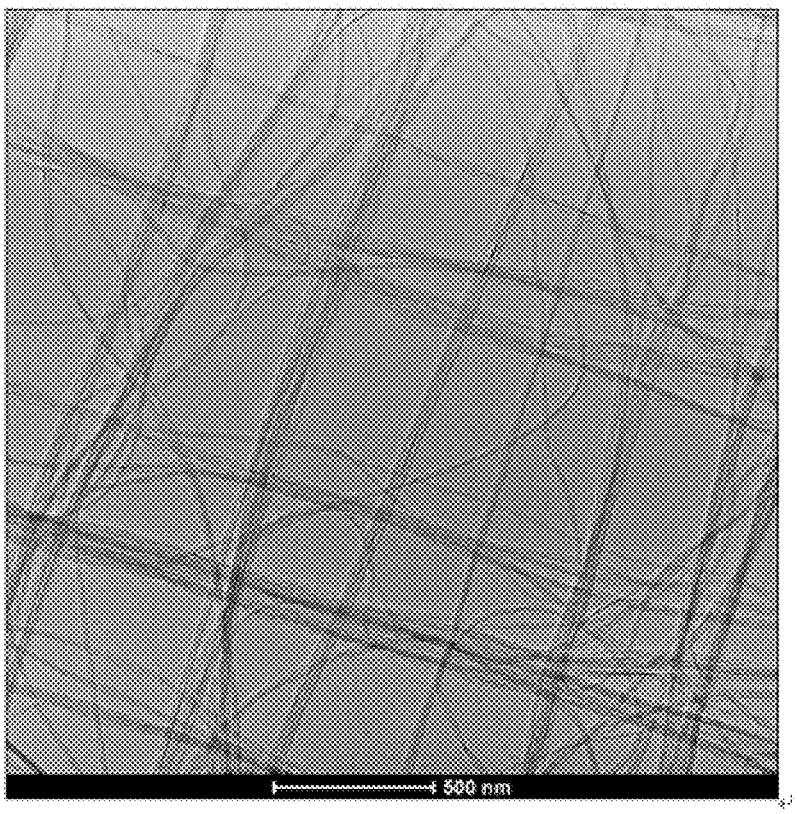
FIG. 3 is a transmission electron microscope (TEM) image of a carbon nanotube structure.

Referring to FIGS. 2 and 3, the filter layer 20 includes a carbon nanotube structure. The carbon nanotube structure includes a plurality of carbon nanotubes without impurities. In one embodiment, the filter layer 20 is a pure carbon nanotube structure and consists of just carbon nanotubes. The carbon nanotube structure includes a plurality of carbon nanotube films stacked and crossed with each other. The carbon nanotube structure includes a plurality of micropores. A diameter of a micropore of the plurality of micropores is larger than 1 micrometer and less than 2.5 micrometers.

Each of the plurality of carbon nanotube films can be a drawn carbon nanotube film, a flocculated carbon nanotube film, or a pressed carbon nanotube film.

Figure 4:
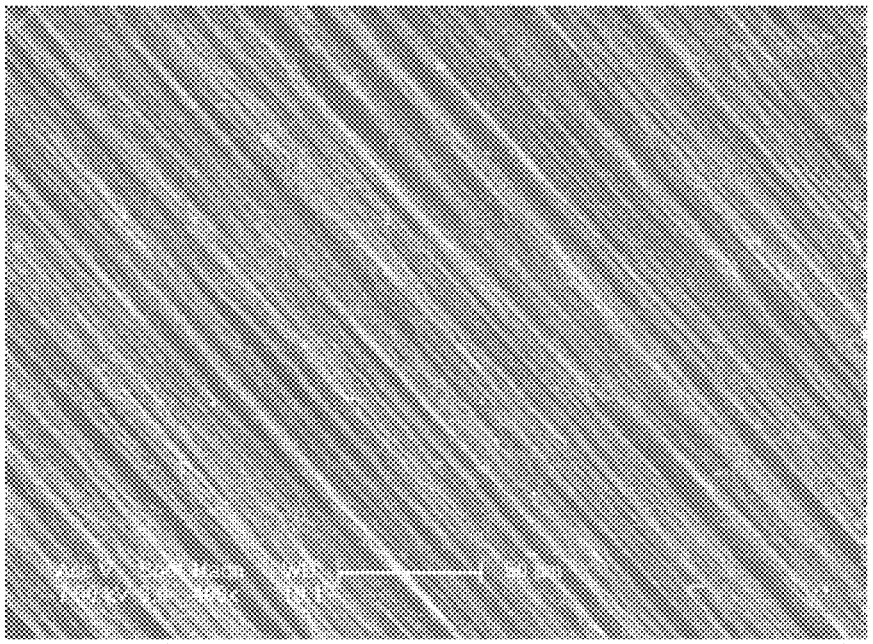
FIG. 4 is an SEM image of a drawn carbon nanotube film.

FIG. 4 illustrates that the drawn carbon nanotube film includes a number of carbon nanotubes that are arranged substantially parallel to a surface of the drawn carbon nanotube film. A large number of the carbon nanotubes in the drawn carbon nanotube film can be oriented along a preferred direction, meaning that a large number of the carbon nanotubes in the drawn carbon nanotube film are arranged substantially along the same direction. An end of one carbon nanotube is joined to an end of an adjacent carbon nanotube arranged substantially along the same direction by van der Waals force, to form a free-standing film. The term 'free-standing' includes films that do not have to be supported by a substrate. The drawn carbon nanotube film can be formed by drawing from a carbon nanotube array. Examples of a drawn carbon nanotube film are taught by U.S. Pat. No. 7,045,108 to Jiang et al., and US patent application US 2008/0170982 to Zhang et al. A width of the drawn carbon nanotube film relates to the carbon nanotube array from which the drawn carbon nanotube film is drawn. A thickness of the carbon nanotube drawn film can range from about 0.5 nanometers to about 100 micrometers.

A minority of carbon nanotubes in the drawn carbon nanotube film may be randomly aligned. However, the number of randomly aligned carbon nanotubes is very small and does not affect the overall oriented alignment of the majority of carbon nanotubes in the drawn carbon nanotube film. The majority of the carbon nanotubes in the drawn carbon nanotube film substantially aligned along the same direction may not be exactly straight, and can be curved to a certain degree, or are not exactly aligned along the overall aligned direction, and can deviate from the overall aligned direction by a certain degree. Therefore, partial contacts can exist between the randomly aligned carbon nanotubes and adjacent carbon nanotubes. The drawn carbon nanotube film includes a plurality of successively oriented carbon nanotube segments joined end-to-end by van der Waals force. Each carbon nanotube segment includes a plurality of carbon nanotubes substantially parallel to each other, combined together by van der Waals force.

Figure 5:
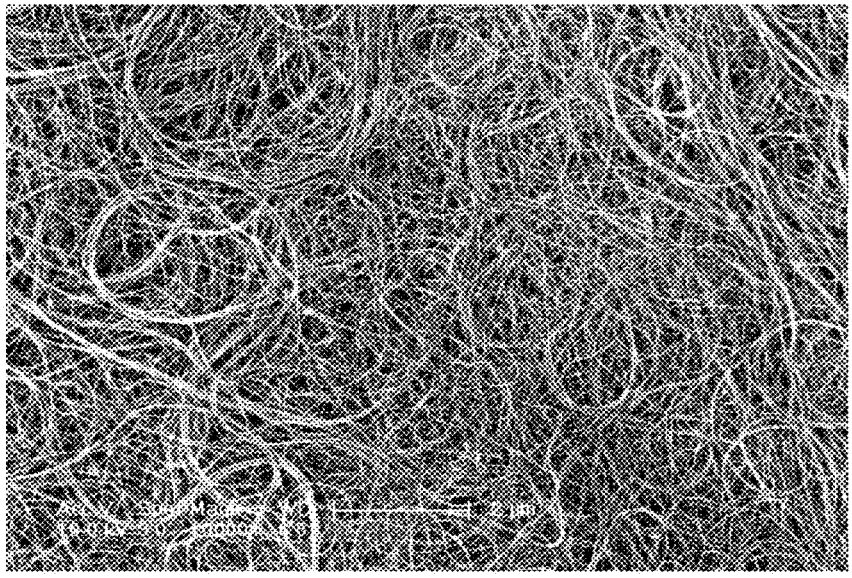
FIG. 5 is an SEM image of a flocculated carbon nanotube film.

FIG. 5 illustrates a flocculated carbon nanotube film which can include a number of carbon nanotubes entangled with each other. The carbon nanotubes can be substantially uniformly distributed in the flocculated carbon nanotube film. The flocculated carbon nanotube film can be formed by flocculating the carbon nanotube array. Examples of the flocculated carbon nanotube film are taught by U.S. Pat. No. 8,846,144 to Wang et al.

Figure 6:
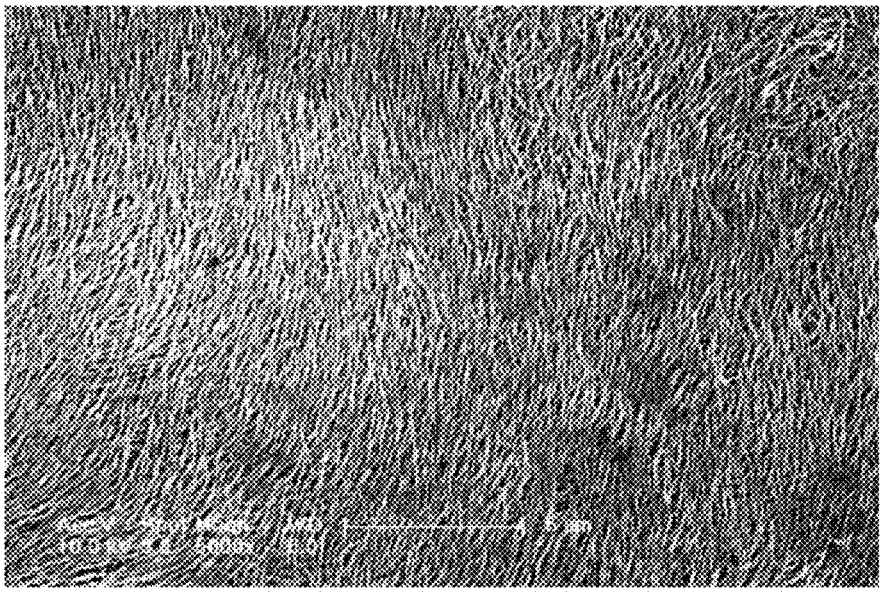
FIG. 6 is an SEM image of a pressed carbon nanotube film.

FIG. 6 illustrates a pressed carbon nanotube film which can include a number of disordered carbon nanotubes arranged along a same or different directions. Adjacent carbon nanotubes are attracted to each other and combined by van der Waals force. A planar pressure head can be used to press the carbon nanotubes array along a direction perpendicular to a substrate, thereby a pressed carbon nanotube film having a plurality of isotropically arranged carbon nanotubes can be obtained. A roller-shaped pressure head can be used to press the carbon nanotubes array along a fixed direction, thereby a pressed carbon nanotube film having a plurality of carbon nanotubes aligned along a fixed direction is obtained. The roller-shaped pressure head can also be used to press the array of carbon nanotubes along different directions, thereby a pressed carbon nanotube film having a plurality of carbon nanotubes aligned along different directions is obtained. Examples of pressed carbon nanotube films are taught by US PGPub. 20080299031A1 to Liu et al.

Adjacent carbon nanotube films of the plurality of carbon nanotube films can be combined simply by van der Waals force. In some embodiments, the number of films of the plurality of carbon nanotube films is in a range from about four to about eight. When the number of carbon nanotube films is too small, the diameter of the micropores will be large, which is not appropriate for trapping PM 2.5. When the number of carbon nanotube films is too large, the breathability of the PM 2.5 mask 100 will be reduced.

When a large number of the carbon nanotubes in each carbon nanotube film of the carbon nanotube structure is oriented along a preferred orientation, an angle between the aligned directions of the carbon nanotubes in two adjacent carbon nanotube films can range from about 0 degrees to about 90 degrees.

In one embodiment, the carbon nanotube structure consists of four drawn carbon nanotube films stacked and crossed with each other, the angle between the aligned directions of the carbon nanotubes in adjacent drawn carbon nanotube films is about 90 degrees, and the diameter of the micropores is about 1.5 micrometers.

In one embodiment, the carbon nanotube structure includes a plurality of carbon nanotube wires. The carbon nanotube wires can be parallel to each other, braided together, or twisted together to form a carbon nanotube film. In one embodiment, the plurality of carbon nanotube wires are arranged along a same direction, a gap being defined between adjacent carbon nanotube wires.

The carbon nanotube wire can be an untwisted carbon nanotube wire or a twisted carbon nanotube wire.

Figure 7:
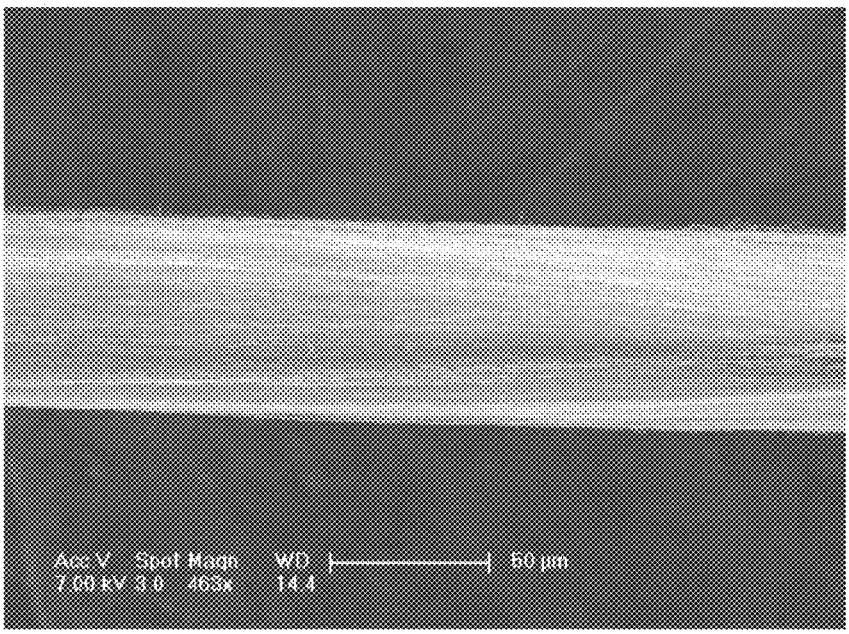
FIG. 7 is an SEM image of a twisted carbon nanotube wire.

FIG. 7 illustrates that the untwisted carbon nanotube wire includes a plurality of carbon nanotubes substantially oriented along a length of the untwisted carbon nanotube wire. The untwisted carbon nanotube wire can be formed by treating a drawn carbon nanotube film with a volatile organic solvent. The drawn carbon nanotube film can be formed by drawing a film from a carbon nanotube array; the drawn carbon nanotube film being a free-standing structure. The drawn carbon nanotube film includes a plurality of carbon nanotube segments joined end-to-end by van der Waals force. Each carbon nanotube segment includes a plurality of carbon nanotubes substantially parallel to each other, and combined by van der Waals force. A length of the untwisted carbon nanotube wire can be set as desired. A diameter of the untwisted carbon nanotube wire can range from about 0.5 nanometers to about 100 micrometers. The drawn carbon nanotube film is treated by applying an organic solvent to the drawn carbon nanotube film so as to soak the entire surface of the drawn carbon nanotube film. After being soaked by the organic solvent, adjacent parallel carbon nanotubes in the drawn carbon nanotube film will bundle together when the organic solvent volatilizes, due to the surface tension of the organic solvent, thus the drawn carbon nanotube film will shrink into the untwisted carbon nanotube wire. The organic solvent can be volatile organic solvents, such as ethanol, methanol, acetone, dichloroethane, or chloroform. Compared with the drawn carbon nanotube film, a specific surface area of the untwisted carbon nanotube wire is decreased, and a viscosity of the untwisted carbon nanotube wire is increased.

Figure 8:
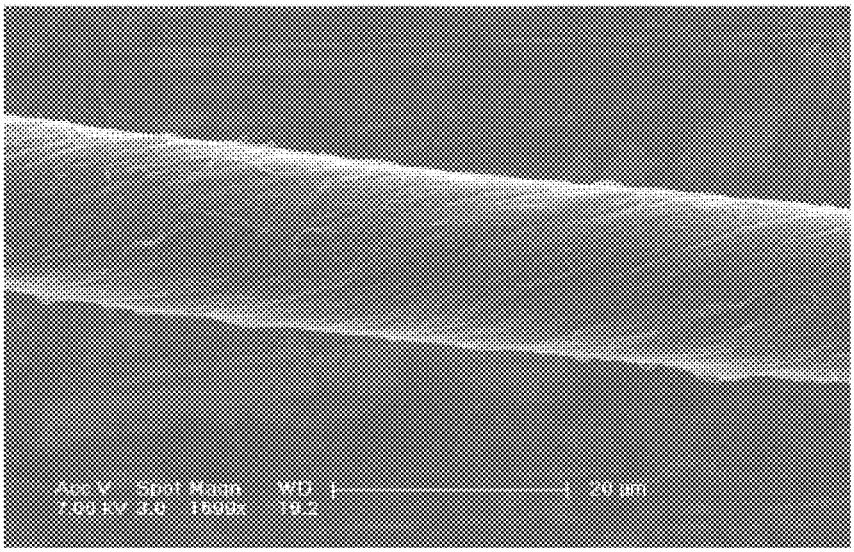
FIG. 8 is an SEM image of an untwisted carbon nanotube wire.

FIG. 8 illustrates that the twisted carbon nanotube wire includes a plurality of carbon nanotubes spirally arranged along an axial direction of the twisted carbon nanotube wire. The twisted carbon nanotube wire is formed by twisting a carbon nanotube film. In one embodiment, the twisted carbon nanotube wire is treated by applying an organic solvent to the twisted carbon nanotube film. After being soaked by the organic solvent, adjacent parallel carbon nanotubes in the carbon nanotube wire will bundle together as the organic solvent volatilizes, due to the surface tension of the organic solvent. A specific surface area of the twisted carbon nanotube wire is decreased, and a viscosity of the twisted carbon nanotube wire is increased.

Examples of carbon nanotube wire are taught by U.S. Pat. No. 7,045,108 to Jiang et al., and US patent application U.S. Pat. No. 8,602,765 to Jiang et al.

In one embodiment, the PM 2.5 mask 100 further includes an absorbent layer. The absorbent layer is located in the gap of the mask body 10. The absorbent layer absorbs atmospheric water vapor.

In one embodiment, the PM 2.5 mask 100 further includes a supporter located in the mask body 10. The absorbent layer is used to form a large cavity in the PM 2.5 mask to expand the effective flow area, thereby reducing the respiratory effort of wearers. A material of the supporter can be plastic or metal.

When the carbon nanotube structure includes four to eight carbon nanotube films stacked and crossed with each other, the diameter of the micropores in the carbon nanotube structure is larger than 1 micrometer and less than 2.5 micrometers. The PM 2.5 mask not only has excellent breathability but can filter PM 2.5 efficiently.

The PM 2.5 mask has excellent bend resistance and very little weight due to the excellent mechanical properties and light weight of the carbon nanotube structure.

A specific surface area of the carbon nanotubes is about 170 $m^2/g$, the carbon nanotube structure can filter out toxic gases from the air, thus the PM 2.5 mask can purify air without additional adsorption layers.

The carbon nanotubes have low specific surface area, and are combined by van der Waals force. Thus, the carbon nanotube structure has viscosity and can be adhered directly on the mask body 10 without an adhesive. Additionally, the carbon nanotube structure uses this property of adherence to adhere to impurities which are difficult to filter.

It is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

What is claimed is:

1. A PM 2.5 mask comprising:

a mask body; and a filter layer located in the mask body, wherein the filter layer comprises a carbon nanotube structure comprising a plurality carbon nanotube films stacked and crossed with each other; and the carbon nanotube structure comprises a plurality of micropores, each of the plurality of carbon nanotube films comprises a plurality of carbon nanotube wires, and the plurality of carbon nanotube wires are braided or twisted together; a diameter of the plurality of micropores is ranged from about 1 micrometer to about 2.5 micrometers.

2. The PM 2.5 mask of claim 1, wherein each of the plurality of carbon nanotube films is selected from the group consisting of a drawn carbon nanotube film, a flocculated carbon nanotube film, and a pressed carbon nanotube film.

3. The PM 2.5 mask of claim 1, wherein the carbon nanotube structure comprises four to eight drawn carbon nanotube films.

4. The PM 2.5 mask of claim 3, wherein an angle between aligned directions of carbon nanotubes in adjacent drawn carbon nanotube films ranges from about 0 degrees to about 90 degrees.

5. The PM 2.5 mask of claim 4, wherein the carbon nanotube structure comprises four drawn carbon nanotube films stacked and crossed with each other, the angle between the aligned directions of the carbon nanotubes in two adjacent drawn carbon nanotube films is about 90 degrees.

6. The PM 2.5 mask of claim 1, wherein the diameter of the plurality of micropores is about 1.5 micrometers.

7. The PM 2.5 mask of claim 1, further comprising an opening located on one side of the mask body, wherein two ends of the opening are connected via a connector.

8. The PM 2.5 mask of claim 1, further comprising an absorbent layer located in the mask body.

9. The PM 2.5 mask of claim 1, further comprising a supporter located in the mask body.

10. The PM 2.5 mask of claim 1, wherein a specific surface area of the carbon nanotubes is about 170 $m^2/g$.

11. The PM 2.5 mask of claim 1, wherein the carbon nanotube structure is adhered directly on the mask body without an adhesive.

12. The PM 2.5 mask of claim 1, wherein impurities not being filtered are adhered to the carbon nanotube structure.

* * * * *